US007837499B1

(12) United States Patent
Chen

(10) Patent No.: US 7,837,499 B1
(45) Date of Patent: Nov. 23, 2010

(54) USB CONNECTOR

(75) Inventor: Po-Jung Chen, Taoyuan (TW)

(73) Assignee: U.D. Electronic Corp., Taoyuan (TW)

( * ) Notice: Subject to any disclaimer, the term of this patent is extended or adjusted under 35 U.S.C. 154(b) by 0 days.

(21) Appl. No.: 12/591,184

(22) Filed: Nov. 12, 2009

(51) Int. Cl.
*H01R 13/60* (2006.01)
*H01R 13/648* (2006.01)

(52) U.S. Cl. ..... 439/541.5; 439/607.23

(58) Field of Classification Search ..... 439/541.5, 439/607.23–607.27, 607.31–607.4, 607.55, 439/79

See application file for complete search history.

(56) References Cited

U.S. PATENT DOCUMENTS 5,772,453 A * 6/1998 Tan et al. ..... 439/79
7,232,346 B2 * 6/2007 Hu et al. ..... 439/660
7,588,445 B2 * 9/2009 He et al. ..... 439/79
7,604,490 B2 * 10/2009 Chen et al. ..... 439/79
7,682,163 B2 * 3/2010 Hou et al. ..... 439/79
7,686,656 B2 * 3/2010 Zheng et al. ..... 439/660
7,731,535 B1 * 6/2010 Wan et al. ..... 439/607.4
7,736,184 B1 * 6/2010 Wan et al. ..... 439/607.11
2003/0199194 A1 * 10/2003 Li ..... 439/541.5
2009/0042450 A1 * 2/2009 Zheng et al. ..... 439/660

* cited by examiner

*Primary Examiner*—T C Patel
*Assistant Examiner*—Vladimir Imas
(74) *Attorney, Agent, or Firm*—Bacon & Thomas, PLLC

(57) ABSTRACT

A USB connector includes an electrically insulative housing having a first connection member holding a first terminal set and a second connection member holding a second terminal set, the first and second terminal set each include fixed terminals and springy terminals arranged in four rows, the rear bonding end pieces of the fixed terminals and the springy terminals being respectively bonded to eighteen through holes of a circuit board that are arranged in four rows in such a manner that the first row and the last row each include five through holes and the other two rows each include four through holes; the rear bonding end pieces of the fixed terminals of the second terminal set being disposed in front of the rear bonding end pieces of the springy terminals of the second terminal set.

10 Claims, 12 Drawing Sheets

USB CONNECTOR

BACKGROUND OF THE INVENTION

1. Field of the Invention

The present invention relates to USB connectors and more particularly, to a USB connector, which has the fixed terminals and springy terminals arranged in four rows inserted through eighteen through holes of a circuit board that are arranged in four rows in such a manner that the first row and the last row each include five through holes and the other two rows each include four through holes. Subject to this arrangement, one USB 3.0 connector and one USB 2.0 can be selectively installed in one common circuit board.

2. Description of the Related Art

Following fast development of modern electronic technology, many different advanced and small-sized electronic devices have been intensively used in our daily life. Nowadays, many people use notebook computer instead of desk computer for the advantage of high mobility. Further, different transmission cables are used for data transmission among different electronic devices. Serial transmission connectors, such as USB (Universal Serial Bus) connectors are intensively used in different electronic devices.

An early design of USB 1.1 connector provides a transmission speed of 1.5 Mbit/s. The invention of USB 2.0 connector improves the transmission speed up to 480 Mbit/s. This design can simply be used in a peripheral apparatus (such as card reader, printer, memory stick, network phone and network camera) of low driving power. Nowadays, these data transmission speeds cannot satisfy the demand for quick transmission of a big amount of data within a limited time, i.e., USB 2.0 cannot be used with a high capacity hard disk drive or DVD copier, DVD player or any advanced blue light electronic device. In consequence, high speed data transmission connectors have been continuously created. For example, USB 3.0 provides a transmission speed as high as 5 Gbit/s. In consideration of compatibility to conventional USB 1.1 or 2.0, USB 3.0 maintains the original metal terminals and adds an extra set of metal terminals, i.e. a USB 3.0 connector has two sets of metal terminals arranged therein. These two sets of metal terminals are separately made from two different metal sheets by a stamping technique and separately bent into shape. After preparation of the two different sets of metal terminals, they are put in an insert-molding mold and molded in an electrically insulative housing. After molding, a metal shield is secured around the periphery of the electrically insulative housing, and a USB 3.0 connector is thus obtained.

FIGS. 11 and 12 illustrate conventional double-stacked USB 3.0 connectors. According to these designs, there are 5 USB 3.0 fixed terminals and 4 USB 2.0 springy terminals respectively positioned in each of the first connection port and the second connection port. The rear bonding end pieces of all the fixed terminals and springy terminals that are respectively bonded to a circuit board are arranged in four rows in such an order from the front side toward the rear side that 4 terminals in one row and 5 terminals in a next row. However, the arrangement of the two rows of USB 3.0 fixed terminals causes the pitch of the USB 2.0 springy terminals to be increased (3.2 mm). Thus, a circuit board designed for the installation of a USB 3.0 connector is not suitable for the installation of a USB 2.0 connector (the terminal pitch of a USB 2.0 connector is 2.63 mm). In consequence, two different designs of circuit boards having different circuit layouts must be prepared for USB 2.0 connector and USB 3.0 connector separately, increasing the cost.

Therefore, it is desirable to provide a USB 3.0 connector, which can be installed in a circuit board for USB 2.0 connector.

SUMMARY OF THE INVENTION

The present invention has been accomplished under the circumstances in view. It is one object of the present invention to provide a USB 3.0 connector design which can be installed in a circuit board for USB 2.0 connector.

To achieve these and other objects of the present invention, a USB connector comprises an electrically insulative housing, a plurality of first connection members and a plurality of second connection members respectively mounted inside the electrically insulative housing, a first terminal set mounted in each first connection member, a second terminal set mounted in each second connection member, each terminal of each of the first terminal sets and second terminal sets comprising a base, a front contact portion extended from one end of the base for the contact of one respective terminal of an external matching USB connector and a rear bonding end piece extended from the other end of the base and inserted through the bottom side of the electrically insulative housing and bonded to an external circuit board. The first terminal set that is mounted in each first connection member and the second terminal set that is mounted in each second connection member each include a plurality of fixed terminals and a plurality of springy terminals arranged in four rows. The rear bonding end pieces of the fixed terminals and the springy terminals are respectively inserted through eighteen through holes of a circuit board that are arranged in four rows in such a manner that the first row and the last row each include five through holes and the other two rows each include four through holes. The rear bonding end pieces of the fixed terminals of the second terminal set are disposed in front of the rear bonding end pieces of the springy terminals of the second terminal set. Subject to the design of the present invention, a USB 2.0 or USB 3.0 connector can be selectively mounted with a driver chip on one same circuit board subject to different requirements. By means of the application of the present invention, the number of the circuit board to be used and the related cost can be greatly reduced.

DETAILED DESCRIPTION OF THE PREFERRED EMBODIMENT

Figure 1:
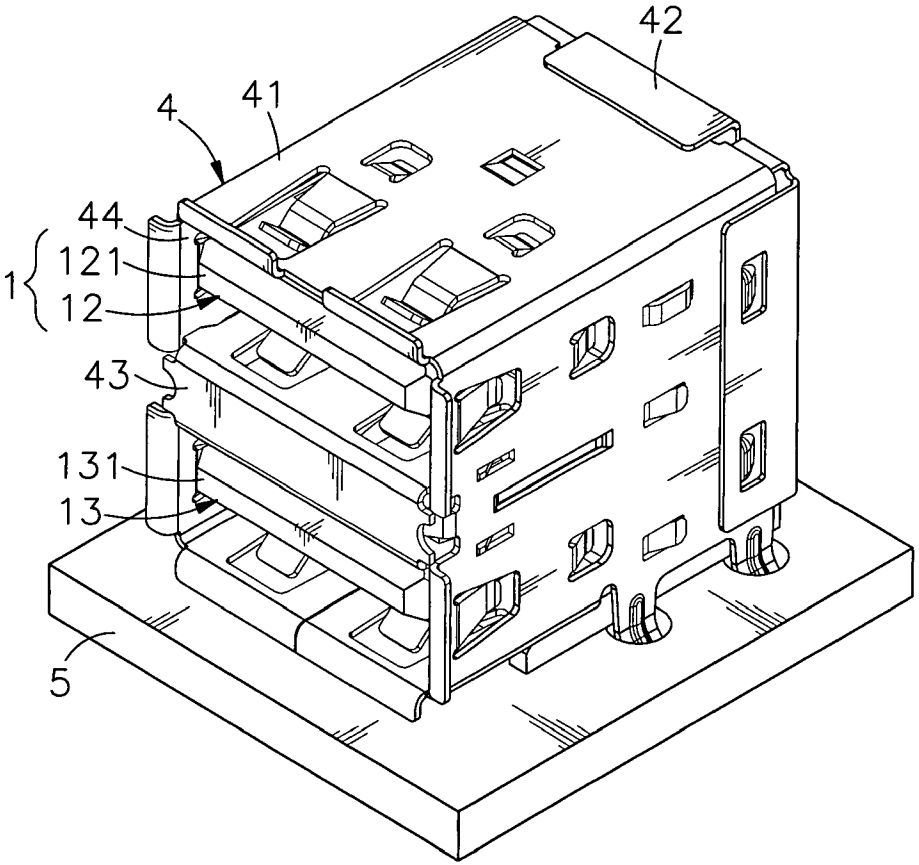
FIG. 1 is an oblique elevation, showing a USB connector installed in a circuit board in accordance with the present invention.
Figure 2:
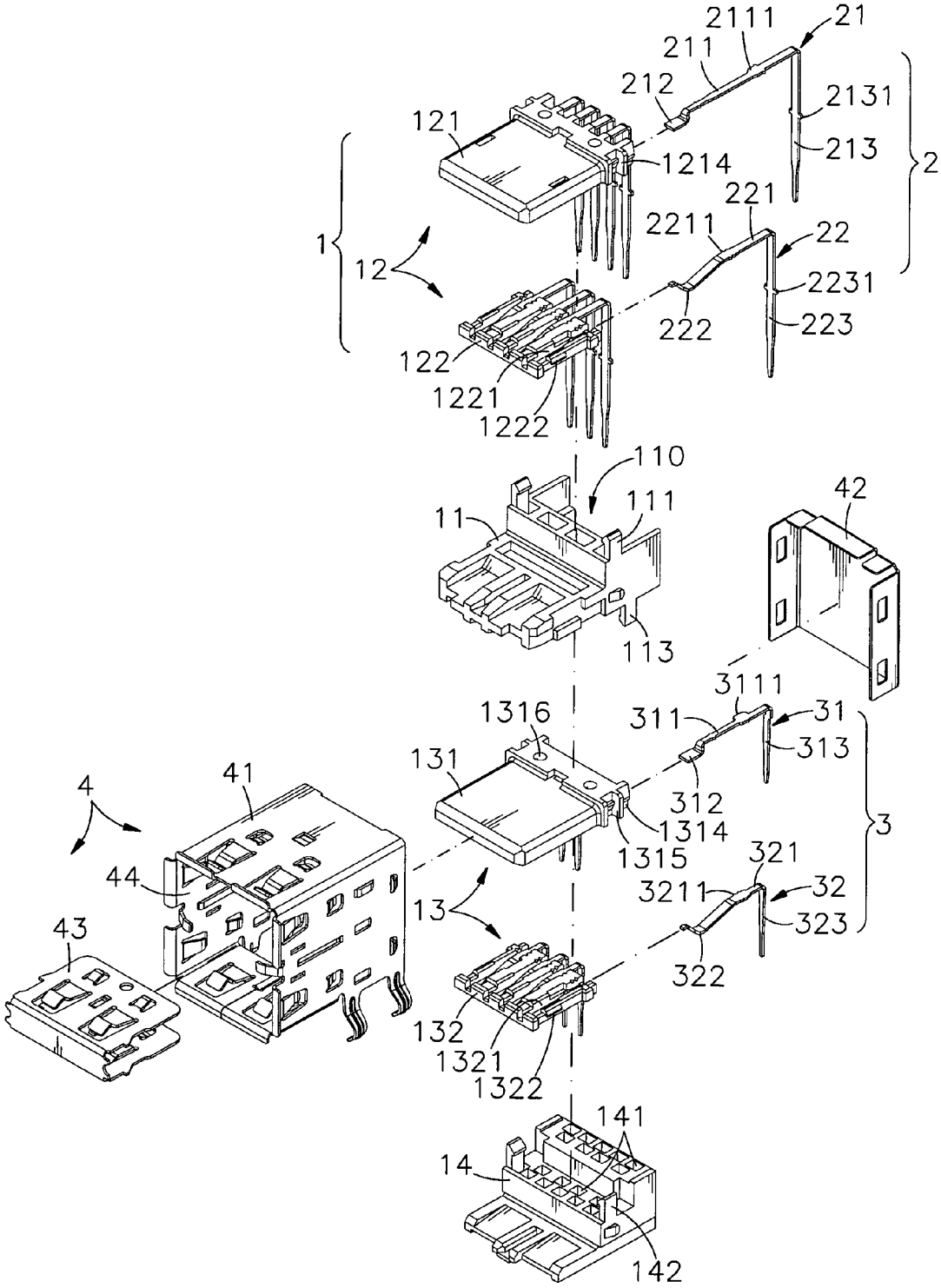
FIG. 2 is an exploded view of the USB connector in accordance with the present invention.
Figure 3:
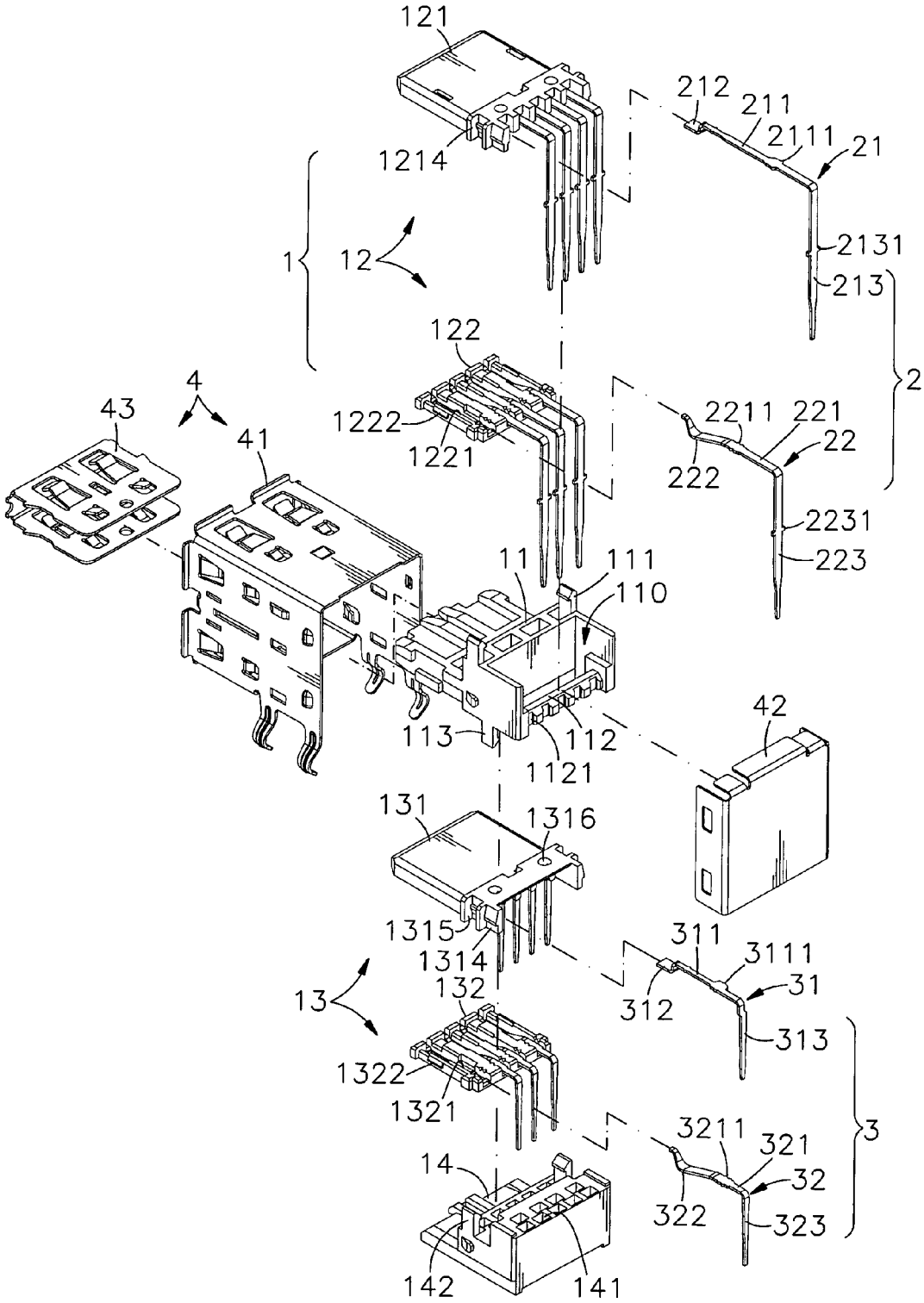
FIG. 3 corresponds to FIG. 2 when viewed from another angle.

Referring to FIGS. 1~4, a USB connector in accordance with the present invention is shown comprising an electrically insulative housing 1, a first terminal set 2, a second terminal set 3 and a metal shield 4.

The electrically insulative housing 1 comprises a base member 11, at least one first connection member 12 arranged at the top side of the base member 11, at least one second connection member 13 arranged at the bottom side of the base member 11 and a bottom positioning member 14 arranged at the bottom side of the at least one second connection member 13. According to this first embodiment, the electrically insulative housing 1 comprises one single first connection member 12 and one single second connection member 13. The base member 11 comprises a plurality of top hooks 111 bilaterally upwardly extended from the top side thereof, a receiving space 110 defined in a rear side relative to the top hooks 111, a transverse flange 112 suspending in the receiving space 110 at a bottom side, a plurality of first locating grooves 1121 and second locating grooves 1121 located on the front and rear sides of the transverse flange 112 in a staggered manner, a plurality of bottom hooks 113 bilaterally downwardly extended from the bottom side thereof and a plurality of bottom mounting rods 114 downwardly extended from the bottom side and transversely aligned between the bottom hooks 113. The first connection member 12 comprises a tongue plate 121 and a terminal holder block 122 arranged at the bottom side of the tongue plate 121. The tongue plate 121 has a plurality of terminal grooves 1211 arranged in parallel on the bottom wall thereof, a plurality of bearing planes 1212 respectively disposed at the bottom wall in front of each of the terminal grooves 1211, a plurality of retaining grooves 1213 located on the bottom wall and respectively disposed at two opposite sides of each of the terminal grooves 1211 and a plurality of hook holes 1214 bilaterally disposed at the rear side thereof. The terminal holder block 122 has a plurality of terminal slots 1221 cut through the top and bottom walls thereof and arranged in parallel and a plurality of retaining blocks 1222 for engaging the retaining grooves 1213 of the tongue plate 121. The second connection member 13 comprises a tongue plate 131 and a terminal holder block 132 arranged at the bottom side of the tongue plate 131. The tongue plate 131 has a plurality of terminal grooves 1311 arranged in parallel on the bottom wall thereof, a plurality of bearing planes 1312 respectively disposed at the bottom wall in front of each of the terminal grooves 1311, a plurality of retaining grooves 1313 located on the bottom wall and respectively disposed at two opposite sides of each of the terminal grooves 1311, a plurality of first hook holes 1314 and second hook holes 1315 bilaterally disposed at the rear side thereof and a plurality of mounting through holes 1316 cut through the top and bottom walls and transversely arranged in line at the rear side. The terminal holder block 132 has a plurality of terminal slots 1321 cut through the top and bottom walls thereof and arranged in parallel and a plurality of retaining blocks 1322 for engaging the retaining grooves 1313 of the tongue plate 131. The bottom positioning member 14 has a plurality of vertical terminal slots 141 arranged in four transverse rows in a staggered manner in the stepped rear side thereof and a plurality of top hooks 142 disposed at two opposite lateral sides relative to the vertical terminal slots 141.

The first terminal set 2 is mounted in the first connection member 12 of the electrically insulative housing 1, comprising a plurality of fixed terminals 21 and a plurality of springy terminals 22 respectively mounted in the terminal grooves 1211 of the tongue plate 121 of the first connection member 12 and the terminal slots 1221 of the terminal holder block 122 of the first connection member 12. Each fixed terminal 21 has a base portion 211 positioned in one terminal groove 1211 of the tongue plate 121, a plurality of first barbed protrusions 2111 protruded from two opposite lateral sides of the base portion 211 and forced into engagement with the associating terminal groove 1211, a front contact portion 212 forwardly extended from one end of the base portion 211 and supported on one respective bearing plane 1212 of the tongue plate 121, a rear bonding end piece 213 perpendicularly downwardly extended from the other end of the base portion 211 and vertically downwardly inserted through the receiving space 110 of the base member 11 and a plurality of second barbed protrusions 2131 protruded from two opposite lateral sides of the rear bonding end piece 213. Each springy terminal 22 has a base portion 221 set in one terminal slot 1221 of the terminal holder block 122, a plurality of first barbed protrusions 2211 protruded from two opposite lateral sides of the base portion 221 and forced into engagement with the associating terminal slot 1221, a front contact portion 222 obliquely forwardly extended from one end of the base portion 221 and protruding over the bottom side of the associating terminal slot 1221, a rear bonding end piece 223 perpendicularly downwardly extended from the other end of the base portion 221 and vertically downwardly inserted through the receiving space 110 of the base member 11 and a plurality of second barbed protrusions 2231 protruded from two opposite lateral sides of the rear bonding end piece 223.

The second terminal set 3 is mounted in the second connection member 13 of the electrically insulative housing 1, comprising a plurality of fixed terminals 31 and a plurality of springy terminals 32 respectively mounted in the terminal grooves 1311 of the tongue plate 131 of the second connection member 13 and the terminal slots 1321 of the terminal holder block 132 of the second connection member 13. Each fixed terminal 31 has a base portion 311 positioned in one terminal groove 1311 of the tongue plate 131, a plurality of first barbed protrusions 3111 protruded from two opposite lateral sides of the base portion 311 and forced into engagement with the associating terminal groove 1311, a front contact portion 312 forwardly extended from one end of the base portion 311 and supported on one respective bearing plane 1312 of the tongue plate 131 and a rear bonding end piece 313 perpendicularly downwardly extended from the other end of the base portion 311 and vertically downwardly inserted through the rear side of the second connection member 13. Each springy terminal 32 has a base portion 321 set in one terminal slot 1321 of the terminal holder block 132, a plurality of first barbed protrusions 3211 protruded from two opposite lateral sides of the base portion 321 and forced into engagement with the associating terminal slot 1321, a front contact portion 322 obliquely forwardly extended from one end of the base portion 321 and protruding over the bottom side of the associating terminal slot 1321 and a rear bonding end piece 323 perpendicularly downwardly extended from the other end of the base portion 221 and vertically downwardly inserted through the rear side of the second connection member 13.

The metal shield 4 includes a front frame shell 41, a rear cover shell 42 and an internal clamping shell 43. The front frame shell 41 and the rear cover shell 42 are fastened together and covered over the electrically insulative housing 1. The internal clamping shell 43 is clamped on the base member 11 of the electrically insulative housing 1.

Figure 4:
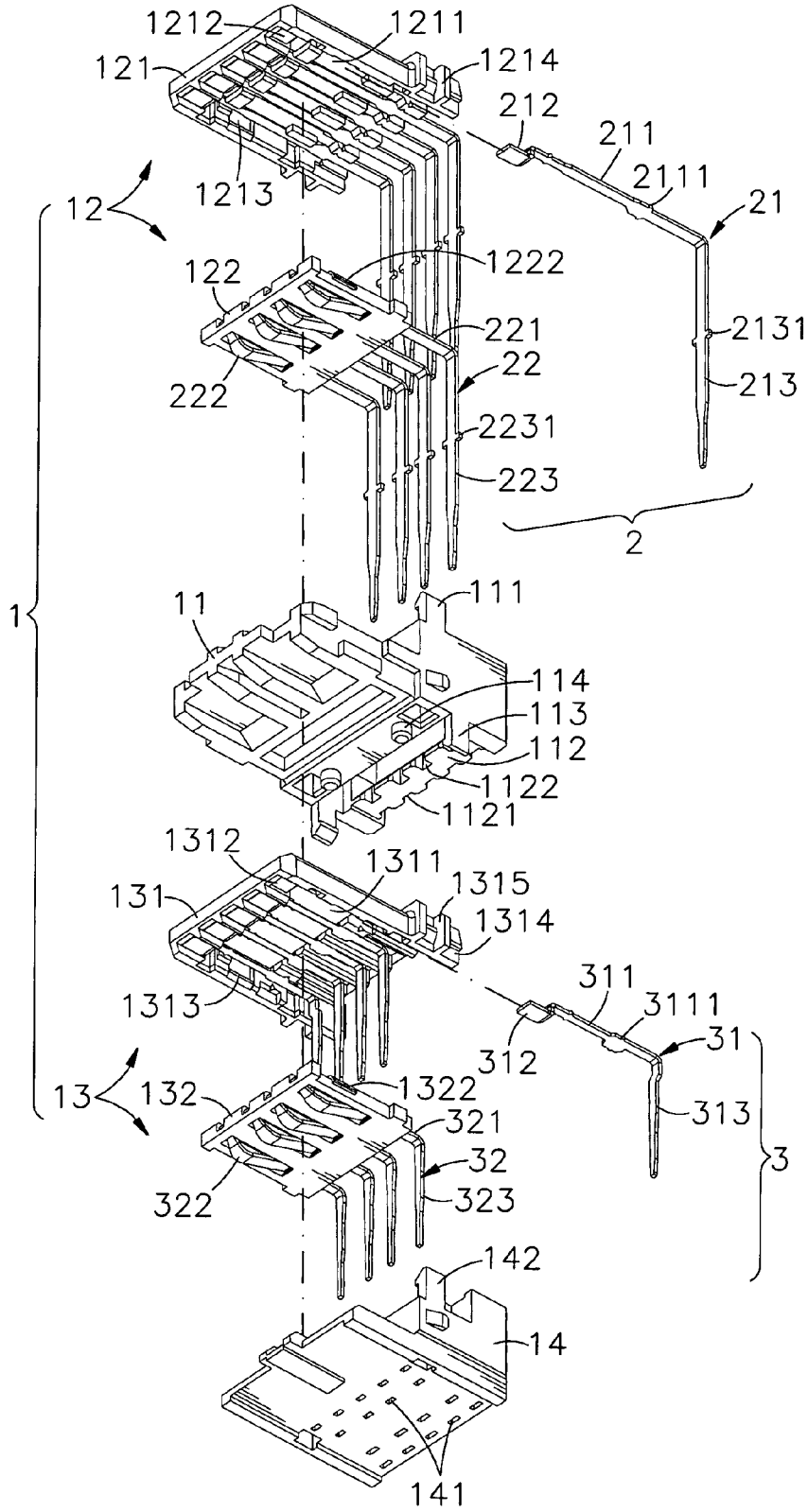
FIG. 4 is a schematic assembly view of a part of the USB connector in accordance with the present invention (I).
Figure 5:
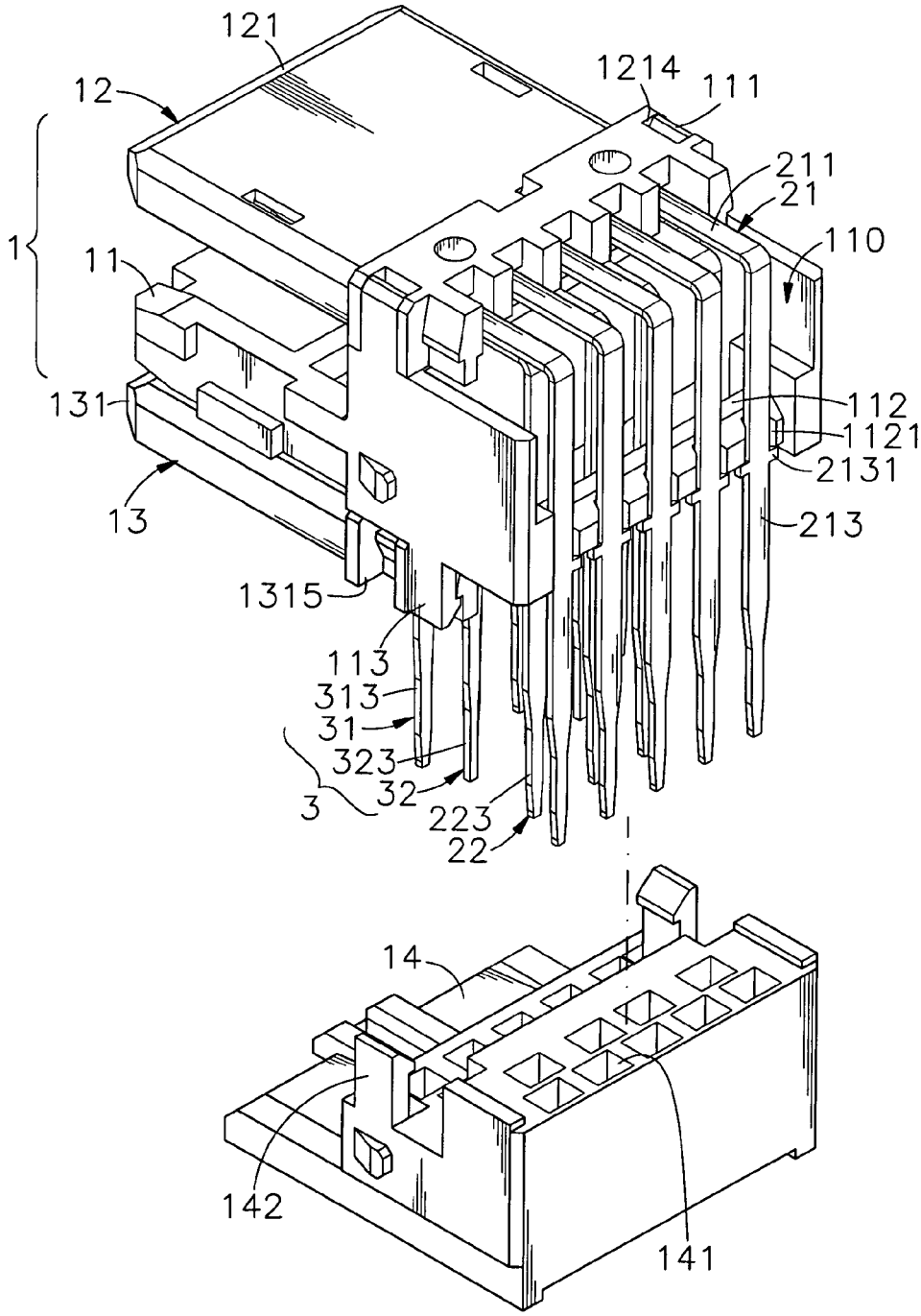
FIG. 5 is a schematic assembly view of a part of the USB connector in accordance with the present invention (II).
Figure 6:
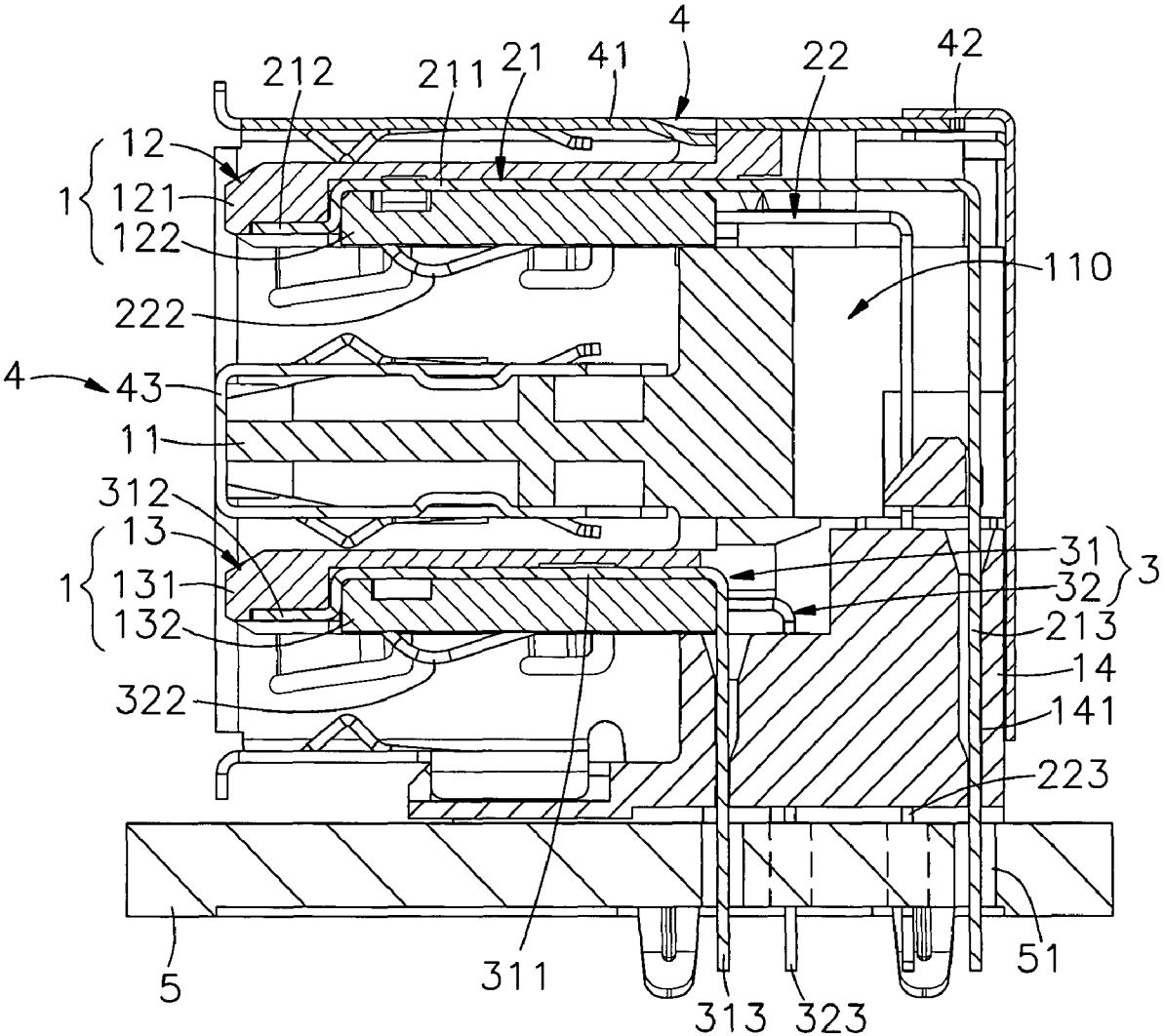
FIG. 6 is a sectional side view of the USB connector in accordance with the present invention.

During installation, as shown in FIGS. 4-6, the hook holes 1214 of the first connection member 12 are respectively forced into engagement with the top hooks 111 of the base member 11 to have the rear bonding end pieces 213 and 223 of the fixed terminals 21 and springy terminals 22 of the first terminal set 2 that are respectively mounted in the tongue plate 121 and terminal holder block 122 of the first connection member 12 extend through the receiving space 110 of the base member 11, and then respectively inserted the rear bonding end pieces 213 and 223 of the fixed terminals 21 and springy terminals 22 of the first terminal set 2 through the first locating grooves 1121 and second locating grooves 1121 at the front and rear sides of the transverse flange 112 of the base member 11 to have the second barbed protrusions 2131 and 2231 of the rear bonding end pieces 213 and 223 of the fixed terminals 21 and springy terminals 22 of the first terminal set 2 be respectively forced into engagement with the lower part of the transverse flange 112 of the base member 11.

Figure 7:
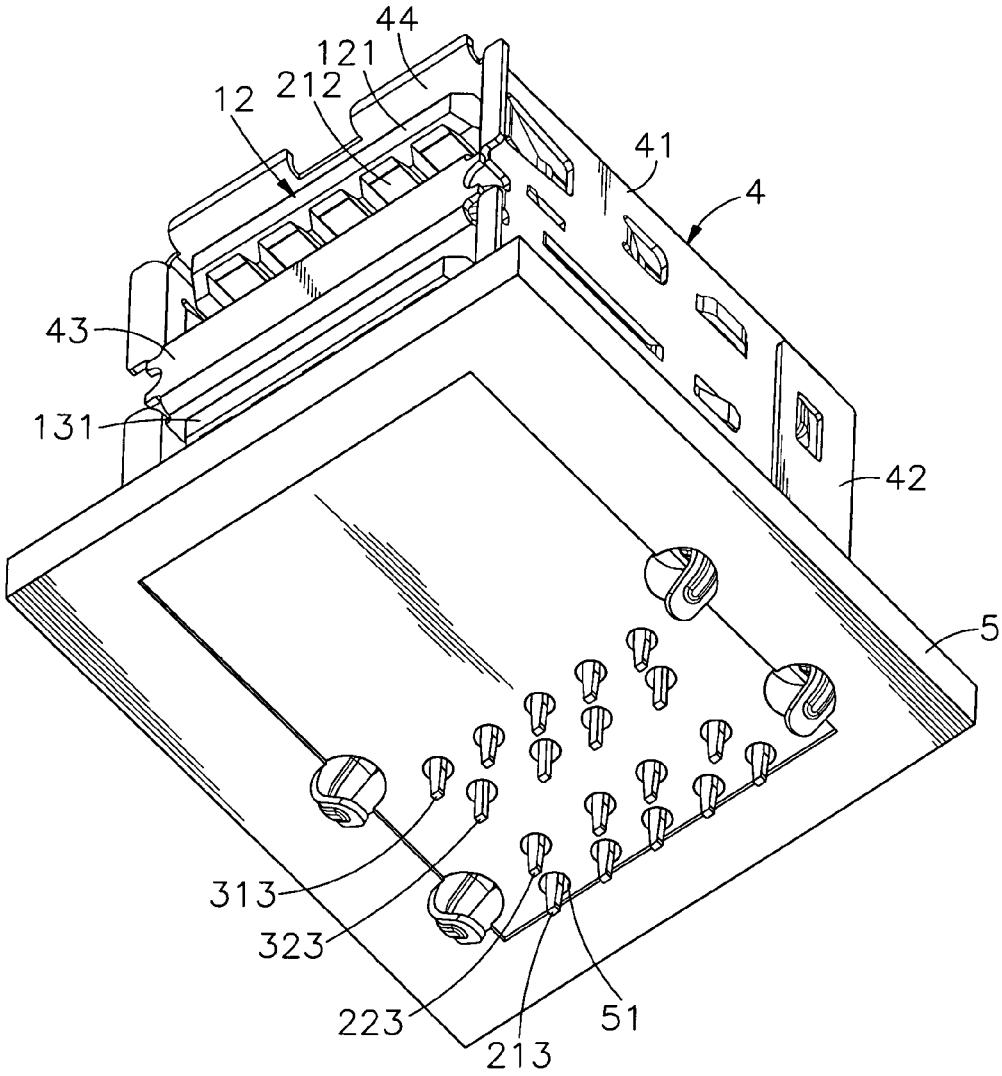
FIG. 7 is an oblique bottom view, showing one application example of the present invention.
Figure 8:
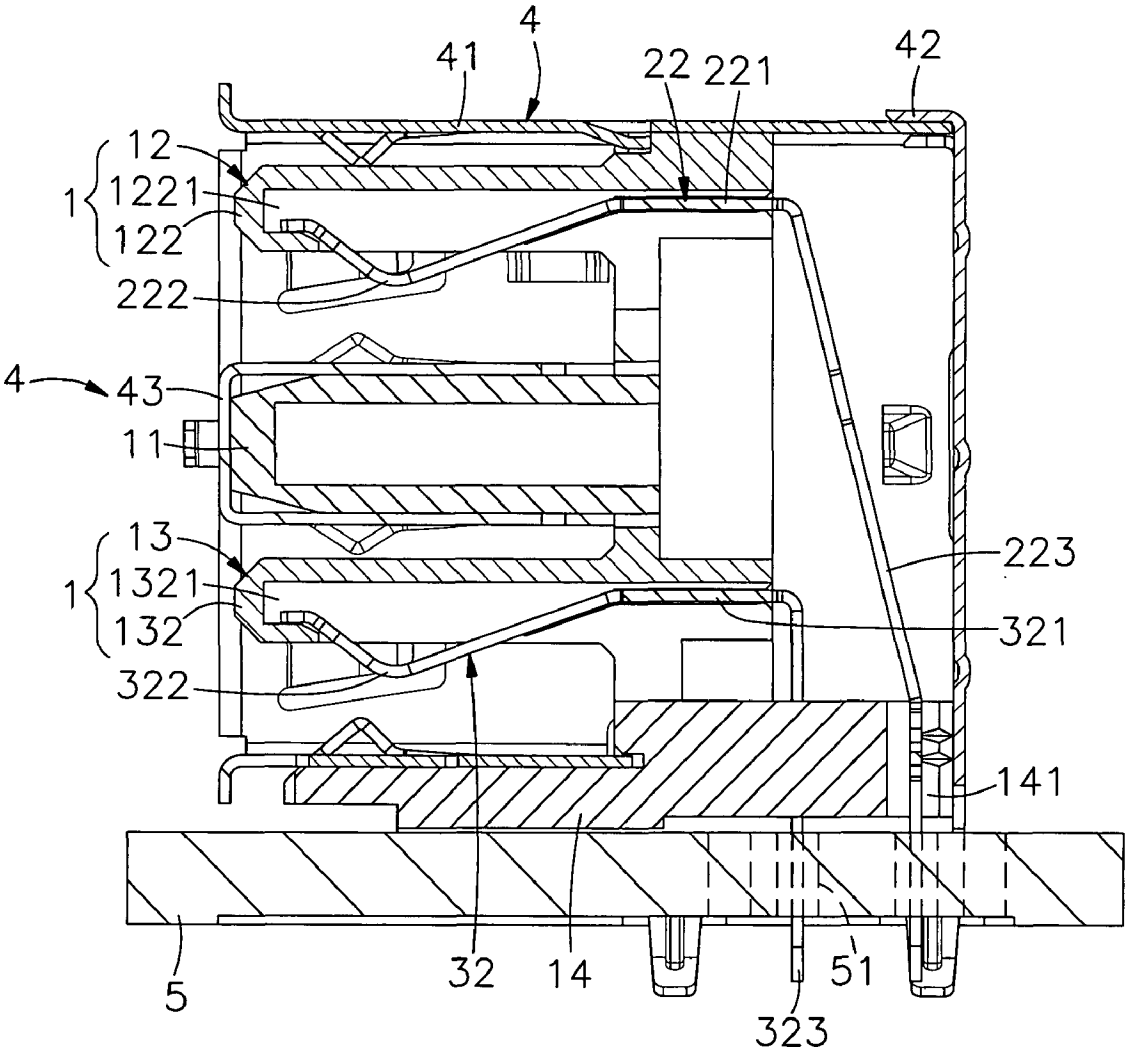
FIG. 8 is a sectional side view, showing another application example of the present invention.
Figure 9:
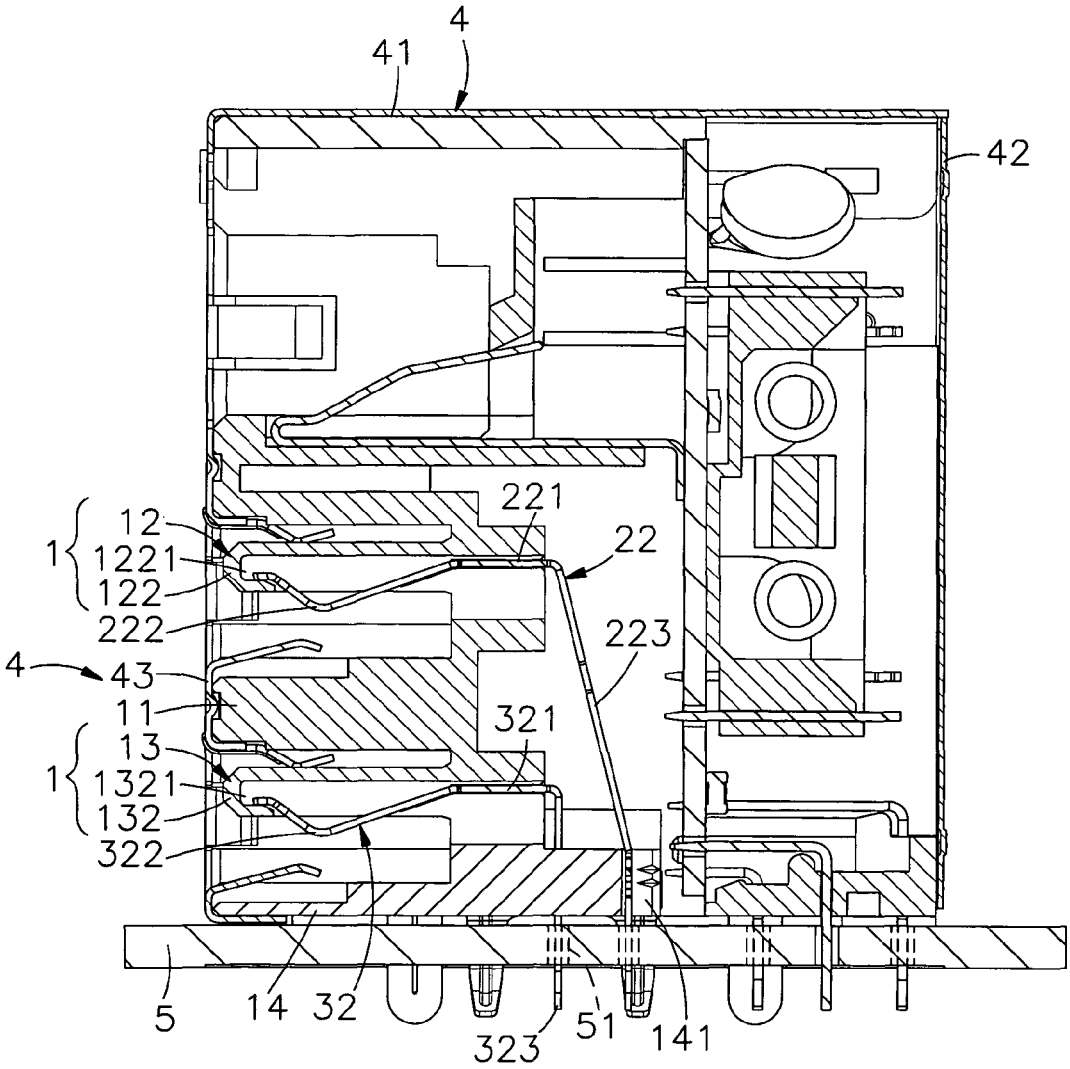
FIG. 9 is a sectional view, showing still another application example of the present invention.
Figure 10:
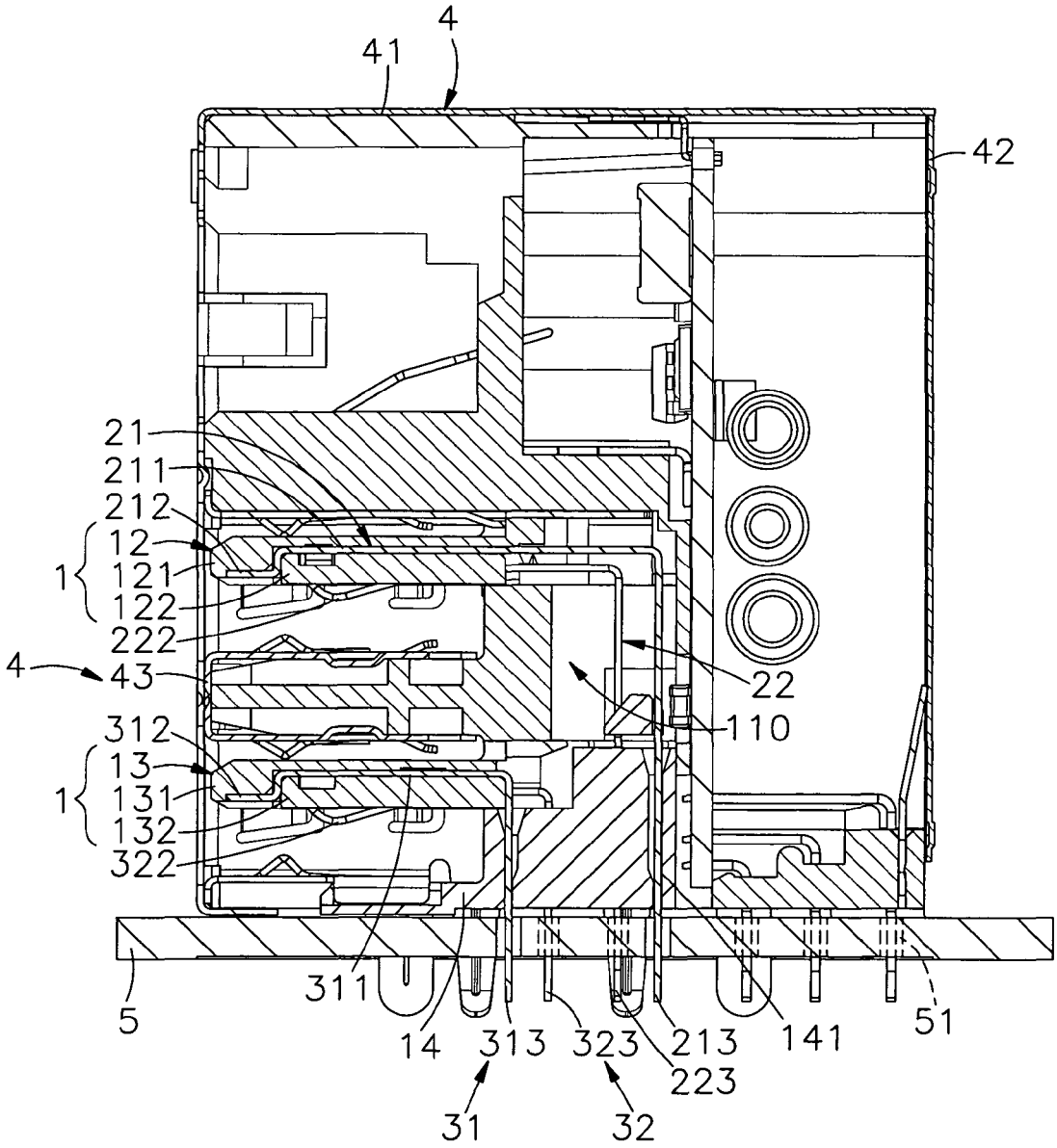
FIG. 10 is a sectional side view, showing still another application example of the present invention.
Figure 11:
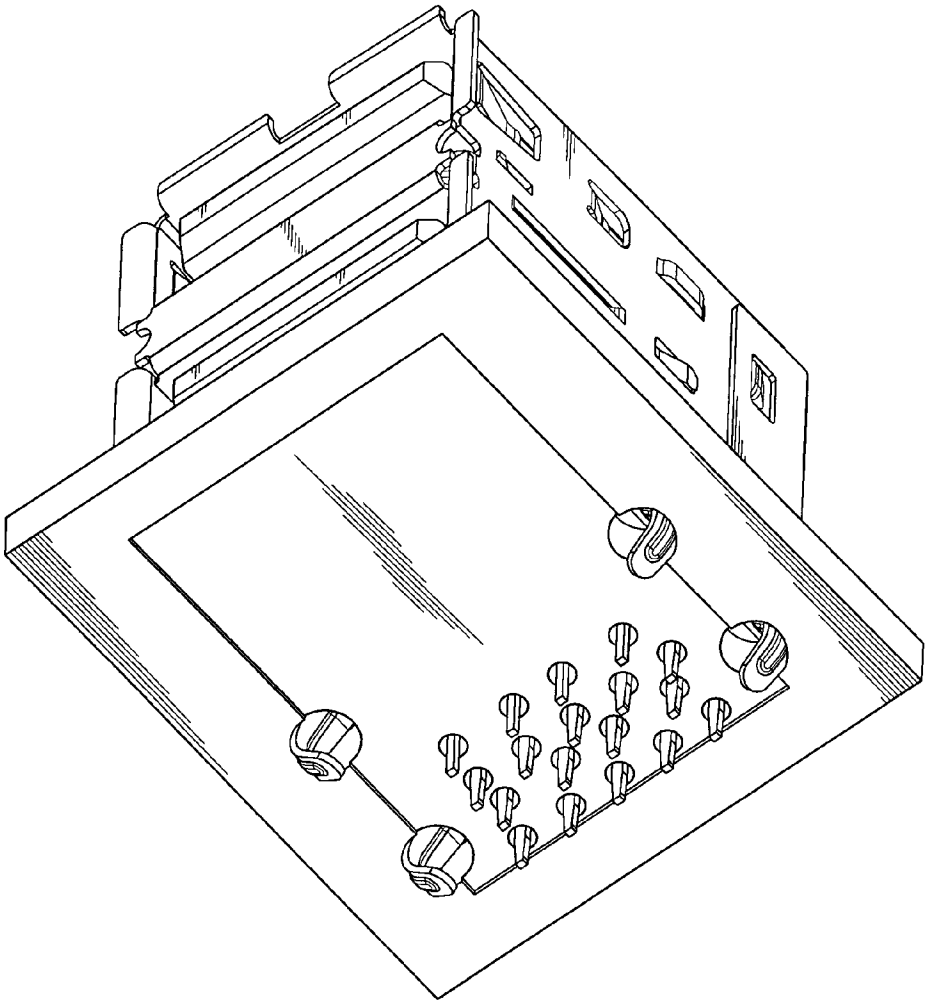
PRIOR ART FIG. 11
FIG. 11 is an oblique bottom elevation, showing a USB connector installed in a circuit board according to the prior art.
Figure 12:
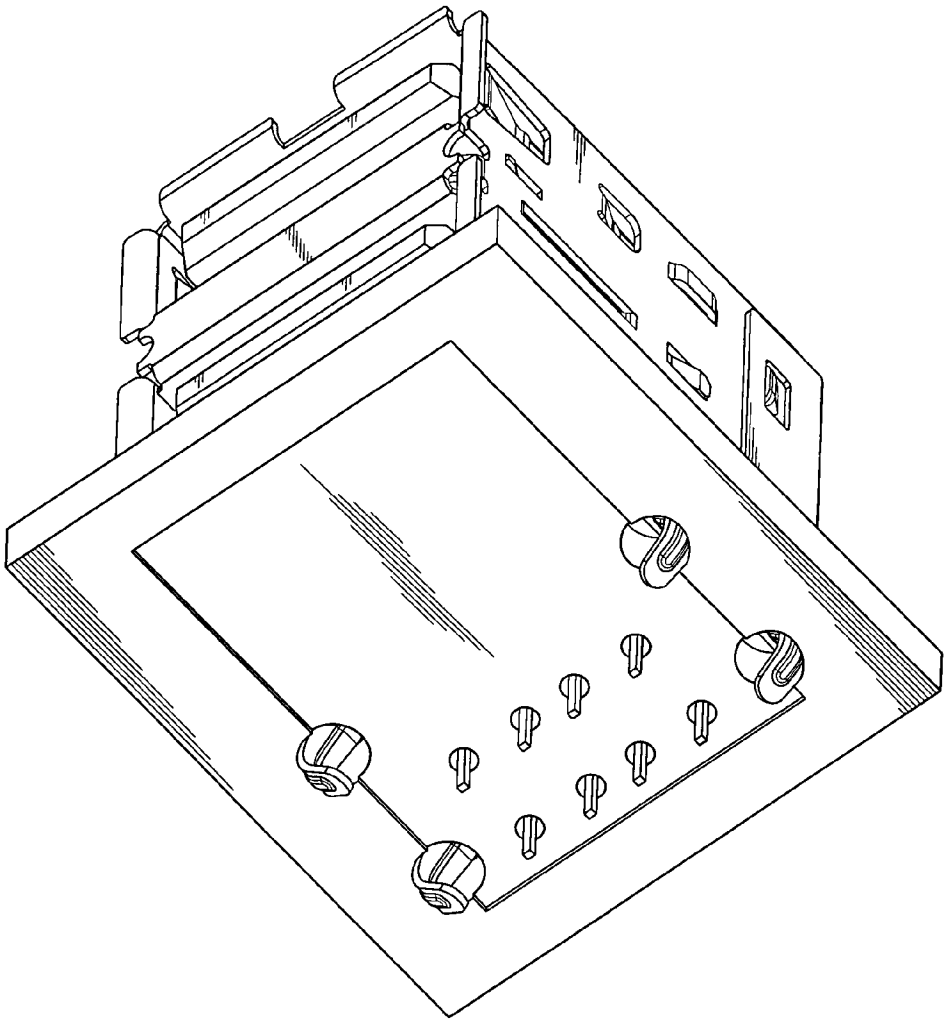
PRIOR ART FIG. 12
FIG. 12 is an oblique bottom elevation, showing another structure of USB connector installed in a circuit board according to the prior art.

Thereafter, force the bottom hooks 113 and bottom mounting rods 114 of the base member 11 into the first hook holes 1314 and mounting through holes 1316 of the tongue plate 131 of the second connection member 13. Thus, the first connection member 12 and the second connection member 13 are fastened to the top and bottom sides of the base member 11. Thereafter, hook the top hooks 142 of the bottom positioning member 14 in the second hook holes 1315 of the tongue plate 131 of the second connection member 13 to let the rear bonding end pieces 213 and 223 of the fixed terminals 21 and springy terminals 22 of the first terminal set 2 and the rear bonding end pieces 313 and 323 of the fixed terminals 31 and springy terminals 32 of the second terminal set 3 be respectively inserted through the terminal slots 141 of the bottom positioning member 14 and then electrically bonded to a circuit board 5 (see FIG. 7). Thereafter, the metal shield 4 is fastened to the electrically insulative housing 1 to have the first connection member 12 and the second connection member 13 be respectively inserted into the upper and lower chambers 44 that are defined in the front frame shell 41 at the top and bottom sides relative to the internal clamping shell 43 for the connection of a USB 3.0 plug.

Referring to FIGS. 7~10, the fixed terminals 21 and springy terminals 22 of the first terminal set 2 and the fixed terminals 31 and springy terminals 32 of the second terminal set 3 are respectively mounted in the first connection member 12 and the second connection member 13 in such a manner that the rear bonding end pieces 213 and 223 of the fixed terminals 21 and springy terminals 22 of the first terminal set 2 and the rear bonding end pieces 313 and 323 of the fixed terminals 31 and springy terminals 32 of the second terminal set 3 are respectively inserted through the terminal slots 141 of the bottom positioning member 14 and respective through holes 51 of the circuit board 5 and then electrically bonded thereto. Further, the metal shield 4 has bottom legs inserted through respective through holes on the circuit board 5 and then bonded to the circuit board 5, forming a grounding loop for the discharging of electromagnetic waves around the USB connector and noises from the circuit board 5 to ground.

Further, the total number of the terminal slots 141 of the bottom positioning member 14 is 18 that are arranged in four rows in such a manner that the first row and the last row (the front row and the rear row) each include 5 terminal slots and the other two rows each include 4 terminal slots. After inserted through the terminal slots 141 of the bottom positioning member 14, the rear bonding end pieces 213 and 223 of the fixed terminals 21 and springy terminals 22 of the first terminal set 2 and the rear bonding end pieces 313 and 323 of the fixed terminals 31 and springy terminals 32 of the second terminal set 3 are respectively electrically bonded to the through holes 51 of the circuit board 5. After bonding, the rear bonding end pieces 313 of the fixed terminals 31 of the second terminal set 3 are disposed in front of the rear bonding end pieces 323 of the springy terminals 32 of the second terminal set 3. Subject to the aforesaid structural design, a double-stacked USB 3.0 connector constructed according to the present invention and a conventional USB 2.0 connector can be selectively installed in one same circuit board 5 of the aforesaid circuit layout. Thus, a USB 2.0 or USB 3.0 connector can be selectively mounted with a driver chip on one same circuit board 5 subject to different client requirements. By means of the application of the present invention, the number of the circuit board 5 to be used and the related cost can be greatly reduced. Further, the invention simplifies the circuit arrangement of the circuit board 5 and saves much the circuit layout space of the circuit board 5.

As stated above, the circuit board 5 has eighteen through holes 51 corresponding to the terminal slots 141 of the bottom positioning member 14 of the electrically insulative housing 1 of the USB 3.0 connector made according to the present invention. The arrangement of the eighteen through holes 51 of the circuit board 5 is also practical for the installation of the springy terminals of a double-stacked USB 2.0 connector. When a double-stacked USB 2.0 connector is used, the rear bonding end pieces of the double-stacked USB 2.0 connector are respectively electrically bonded to the two intermediate rows of through holes of the circuit board 5, leaving the five through holes of the first row and the five through holes of the last row in vacant (see FIG. 8). Thus, the circuit layout of the circuit board 5 fits a double-stacked USB 3.0 connector or double-stacked USB 2.0 connector selectively.

When an external matching USB 3.0 connector (USB 3.0 plug) is inserted into the upper or lower chamber 44 of the metal shell 4, the first connection member 12 or second connection member 13 is inserted into the external matching USB 3.0 connector (USB 3.0 plug, keeping the fixed terminals 21 or 31 and spring terminals 22 or 32 of the USB 3.0 connector (USB 3.0 socket) of the present invention in positive contact with the respective fixed terminals and springy terminals of the external matching USB 3.0 connector (USB 3.0 plug) for two-way data signal transmission.

While only one embodiment of the present invention has been described in detail for purposes of illustration various modifications and enhancements may be made thereunto without departing from the spirit and scope of the invention. For example, the invention can also be applied to a USB 3.0+RJ multi-port connector (see FIG. 9), USB 2.0+RJ multi-port connector (see FIG. 10) or any of a variety of other types of connectors. The spirit of the present invention enables a double-stacked USB 3.0 connector to be applicable to a circuit board having a through hole circuit layout for a regular double-stacked USB 2.0 connector. Subject to the application of the present invention, the circuit arrangement of the circuit board 5 is simplified, leaving much surface space for the installation of other electronic components. Accordingly, the invention is not to be limited except as by the appended claims.

What the invention claimed is:

1. A USB connector, comprising: an electrically insulative housing, a plurality of first connection members and a plurality of second connection members respectively mounted inside said electrically insulative housing, a first terminal set mounted in each said first connection member, a second terminal set mounted in each said second connection member, each terminal of each of said first terminal sets and said second terminal sets comprising a base, a front contact portion extended from one end of said base for the contact of one respective terminal of an external matching USB connector and a rear bonding end piece extended from an opposite end of said base and inserted through a bottom side of said electrically insulative housing and bonded to an external circuit board, wherein:

the first terminal set that is mounted in each said first connection member and the second terminal set that is mounted in each said second connection member each include a plurality of fixed terminals and a plurality of springy terminals arranged in four rows and the rear bonding end pieces of said fixed terminals and said springy terminals are respectively inserted through eighteen through holes of a circuit board that are arranged in four rows in such a manner that the first row and the last row each include five through holes and the other two rows each include four through holes; the rear bonding end pieces of the fixed terminals of said second terminal set are disposed in front of the rear bonding end pieces of the springy terminals of said second terminal set.

2. The USB connector as claimed in claim 1, wherein said electrically insulative housing comprises a base member arranged above said second terminal set and below said first terminal set, and a bottom positioning member disposed at a bottom side relative to said second terminal set, said bottom positioning member comprising a plurality of terminal slots cut through top and bottom sides thereof and arranged in four rows for the passing of the rear bonding end pieces of the fixed terminals and springy terminals of said first terminal set and said second terminal set.

3. The USB connector as claimed in claim 2 wherein said base member of said electrically insulative housing comprises a plurality of top hooks bilaterally upwardly extended from a top side thereof, a receiving space defined in a rear side relative to said top hooks, a transverse flange suspending in said receiving space at a bottom side, a plurality of first locating grooves and second locating grooves located on front and rear sides of said transverse flange in a staggered manner for receiving the rear bonding end pieces of the terminals of said first terminal set; each said first connection member comprises a plurality of hook holes respectively forced into engagement with said top hooks of said base member.

4. The USB connector as claimed in claim 2 wherein said base member of said electrically insulative housing further comprises a plurality of bottom hooks bilaterally downwardly extended from a bottom side thereof and a plurality of bottom mounting rods downwardly extended from the bottom side and transversely aligned between said bottom hooks; said second connection member of said electrically insulative housing comprises a plurality of first hook holes and mounting through holes respectively coupled to the bottom hooks and bottom mounting rods of said base member.

5. The USB connector as claimed in claim 2 wherein said second connection member of said electrically insulative housing further comprises a plurality of second hook holes bilaterally disposed at a rear side thereof; said bottom positioning member of said electrically insulative housing comprises a plurality of top hooks respectively hooked in said second hook holes of said second connection member.

6. The USB connector as claimed in claim 1, wherein said first connection member of said electrically insulative housing comprises a tongue plate and a terminal holder block mounted in a bottom side of the tongue plate, the tongue plate of said first connection member comprising a plurality of terminal grooves arranged on the bottom side of the tongue plate of said first connection member for the positioning of the respective fixed terminals of said first terminal set, the terminal holder block of said first connection member comprising a plurality of terminal slots for receiving the respective springy terminals of said first terminal set for enabling the front contact portion of each of the respective springy terminals to suspend below the respective terminal slot.

7. The USB connector as claimed in claim 6, wherein the tongue plate of said first connection member further comprises a bearing plane disposed at a front side of each of the terminal grooves thereof for supporting the front contact portion of the associating fixed terminal.

8. The USB connector as claimed in claim 1, wherein said second connection member of said electrically insulative housing comprises a tongue plate and a terminal holder block mounted in a bottom side of the tongue plate, the tongue plate of said second connection member comprising a plurality of terminal grooves arranged on the bottom side of the tongue plate of said second connection member for the positioning of the respective fixed terminals of said second terminal set, the terminal holder block of said second connection member comprising a plurality of terminal slots for receiving the respective springy terminals of said second terminal set for enabling the front contact portion of each of the respective springy terminals to suspend below the respective terminal slot.

9. The USB connector as claimed in claim 8, wherein the tongue plate of said second connection member further comprises a bearing plane disposed at a front side of each of the terminal grooves thereof for supporting the front contact portion of the associating fixed terminal.

10. The USB connector as claimed in claim 1, wherein said metal shield comprises a front frame shell, a rear cover shell and an internal clamping shell, said front frame shell and said rear cover shell being fastened together to surround said electrically insulative housing, said internal clamping shell being clamped on said base member of said electrically insulative housing and defining with said front frame shell an upper chamber and a lower chamber for the insertion of an external matching USB connector.

* * * * *